US010638789B2

(12) United States Patent
Onuma

(10) Patent No.: US 10,638,789 B2
(45) Date of Patent: May 5, 2020

(54) HERB DISPENSER AND ROLLER

(71) Applicant: Eleanya Eke Onuma, Greenbelt, MD (US)

(72) Inventor: Eleanya Eke Onuma, Greenbelt, MD (US)

( * ) Notice: Subject to any disclaimer, the term of this patent is extended or adjusted under 35 U.S.C. 154(b) by 471 days.

(21) Appl. No.: 15/434,716

(22) Filed: Feb. 16, 2017

(65) Prior Publication Data

US 2018/0228206 A1 Aug. 16, 2018

(51) Int. Cl.

| | |
|---|---|
| ***A24C 5/10*** | (2006.01) |
| ***A24B 7/04*** | (2006.01) |
| ***A24C 5/39*** | (2006.01) |

(52) U.S. Cl.

CPC ..... *A24C 5/10* (2013.01); *A24B 7/04* (2013.01); *A24C 5/397* (2013.01); *A24C 5/398* (2013.01)

(58) Field of Classification Search

CPC ..... A24C 5/10; A24C 5/397; A24C 5/398
See application file for complete search history.

(56) References Cited

U.S. PATENT DOCUMENTS

| | | | | |
|---|---|---|---|---|
| 969,274 | A | 9/1910 | Hammerstein | |
| 1,088,827 | A | 3/1914 | Lacroix | |
| 1,271,403 | A | 7/1918 | Williams | |
| 1,858,735 | A | 5/1932 | Goodsell | |
| 2,364,326 | A | 12/1944 | Stephens | |
| 2,415,910 | A | 2/1947 | Roes | |
| 2,565,808 | A | 8/1951 | Friedman | |
| 3,306,498 | A | 2/1967 | Gonzalez | |
| 3,911,933 | A | 10/1975 | Crisp et al. | |
| 5,450,980 | A | 9/1995 | Laidlaw | |
| 7,844,363 | B1 | 11/2010 | Mehdizadeh | |
| 2007/0107738 | A1* | 5/2007 | Barnes | A24C 5/02 131/70 |
| 2017/0280763 | A1* | 10/2017 | Nazarian | A23P 20/12 |
| 2017/0349338 | A1* | 12/2017 | Ziering | B65D 43/22 |
| 2017/0372553 | A1* | 12/2017 | Gray | G07F 11/16 |
| 2018/0035711 | A1* | 2/2018 | Rayson | A24F 15/10 |

FOREIGN PATENT DOCUMENTS

CN 204203698 U * 3/2015

* cited by examiner

*Primary Examiner* — Michael H. Wilson
*Assistant Examiner* — Jennifer A Kessie
(74) *Attorney, Agent, or Firm* — Dunlap Bennett & Ludwig PLLC

(57) ABSTRACT

An herb dispenser is provided. The herb dispenser includes a housing. A receptacle is secured to the housing and includes an inlet and an outlet. An herb may be placed within the receptacle. At least one electronic scale may weigh the herb. The present invention further includes a grinding mechanism. The grinding mechanism includes a motor and an herb grinder disposed within the housing. The grinding mechanism includes an inlet and an outlet. The inlet is positioned to receive an herb from the outlet of the receptacle. The herb dispenser further includes an onboard computer to receive commands from a user and automate the electronic scale and the grinding mechanism to dispense an amount of ground herb from a first delivery port of the housing.

12 Claims, 5 Drawing Sheets

HERB DISPENSER AND ROLLER

BACKGROUND OF THE INVENTION

The present invention relates to delivering herbs and, more particularly, to an herb dispenser and roller.

Medicinal or recreational herbs are typically stored in a re-sealable glass jar or containers. Due to the inherent nature of these re-sealable storage containers, access to the stored herbs is unrestricted for a potential looter. Also after retrieving the medicinal or recreational herb from the storage container the individual must have to perform several tasks prior to use. For example, medicinal herbs, such as medical marijuana, require the user to grind the herb into smaller sizes and rolling the herb into a cylindrical shaped package for use. The art of manually hand rolling these herbs into a cylindrical shaped package is very challenging for many and requires a lot of finger dexterity.

As can be seen, there is a need for an improved herb dispenser and an herb roller.

SUMMARY OF THE INVENTION

In one aspect of the present invention, an herb dispenser comprises: a housing; a receptacle secured to the housing and comprising an inlet and an outlet; at least one electronic scale; a grinding mechanism comprising a motor and an herb grinder disposed within the housing, wherein the grinding mechanism comprises an inlet and an outlet, wherein the inlet is positioned to receive an herb from the outlet of the receptacle; and a computer comprising a processor, a memory and a user interface, wherein the processor: receives a command from the user interface to deliver an amount of an herb; directs the herb grinder to grind the herb; measures the amount of the herb using the electronic scale; and delivers the amount of the herb from the housing through the outlet of the grinding mechanism and out of a first delivery port of the housing.

These and other features, aspects and advantages of the present invention will become better understood with reference to the following drawings, description and claims.

DETAILED DESCRIPTION OF THE INVENTION

Figure 1:
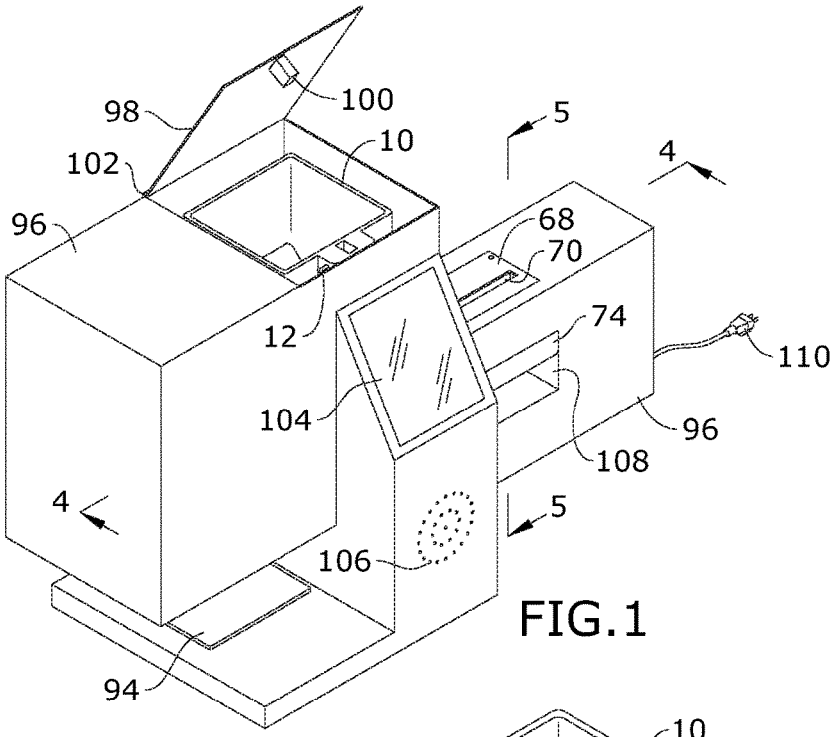
FIG. 1 is a perspective view of an embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes an apparatus for packaging or dispensing a user defined discrete amounts of medicinal or recreational herbs. The apparatus provides a means of storing medicinal or recreational herbs with controlled access to the storage chamber. The present invention prevents theft of the herb from the storage chamber by including a lock box that only opens to those that have authenticated credentials. The apparatus also provide a means to cut and automatically dispense a discrete amount of herbs with an option to automatically package the herb in a cylindrical package with very minimal user input.

The herbal dispenser functionality is accessed via an interactive visual display such as an LCD touch screen. The storage chamber includes an actuator which locks the storage chamber lid when closed. To access the locked storage chamber a method of authentication, such as a PIN, is entered in the interactive visual display. The PIN is authenticated by onboard software and a signal is sent to the actuator to open the storage chamber lid. To avoid injury all other functions of the dispenser is automatically disabled whenever the storage lid is open. The outlet of the storage chamber connects to the inlet of a grinder, such as a cross-cut shredder. The shafts on the cross-cut shredder are coupled together with gears so that a rotation on one shaft induces a rotation on the other shaft. One shaft is coupled to a DC motor which is activated whenever the herb from the storage chamber needs to be cut into smaller pieces.

A screen is housed just under the shredder outlet which allows herbs of certain sizes to pass through to the auger housing below. The auger housing includes an inlet, an auger coupling port and two outlets. The shredder outlet connects to the auger housing inlet with the screen in-between both sub-components. A screw conveyor is located in a trough shaped conduit located at the bottom of the auger housing. At the auger coupling port the auger shaft is supported by an auger bearing and attached to a motor via a motor coupler. The auger housing can convey the shredded herbs to two distinct outlets of the auger housing. One outlet leads to a dispensary receptacle while the other outlet leads to the packaging mechanism.

The dispensary receptacle area includes a transducer and a receptacle plate which is fixed over the transducer. If the user chooses to dispense a certain quantity of herb then after the herbs exit the shredder assembly they fall onto the screw conveyor located in the auger housing. The motor coupled to the screw conveyor then receives a signal from the processing board to turn the screw conveyor counter clockwise. Turing the screw conveyor counter clockwise moves the shredded herbs toward the dispensary receptacle outlet. Once at the outlet the shredded herb falls under the influence of gravity onto the receptacle plate below the opening. The transducer at the dispensary receptacle area polls and signals the processing board when the user defined herb quantity is reached.

If the user chooses the packaging option then the motor coupled to the screw conveyor receives a signal from the processing board to turn screw conveyor clockwise. Turing the screw conveyor clockwise moves the shredded herbs away from the dispensary receptacle outlet towards the packaging mechanism herb inlet. The packaging mechanism includes a paper inlet, herb inlet, a packaging apron, three paper and apron feeder rollers, paper sensor, transducer, package outlet door, gears, bearings and motors. A sensor located at the paper inlet allows the processing board to determine when a packaging paper is inserted into the packaging mechanism. Four cylindrical shaped rubber rods with length approximately equal to the packaging paper but one with a different diameter than the other three rods are positioned in close parallel proximity with each other and assembled with a patterned washers. The shafts on both ends of the configured rollers are confined to the two ends of packaging mechanisms housing via shaft bearings. One of the paper and apron feeder roller shaft is longer than the others to enable motor coupling. The paper and apron feeder rollers are located just below the paper inlet. After applying moisture to the gum of the paper a user feeds the paper into the paper inlet and the ground herbs are rolled into the paper via the rollers. The rolled ground herbs are then dispensed from a delivery port of the packaging mechanism.

Figure 2:
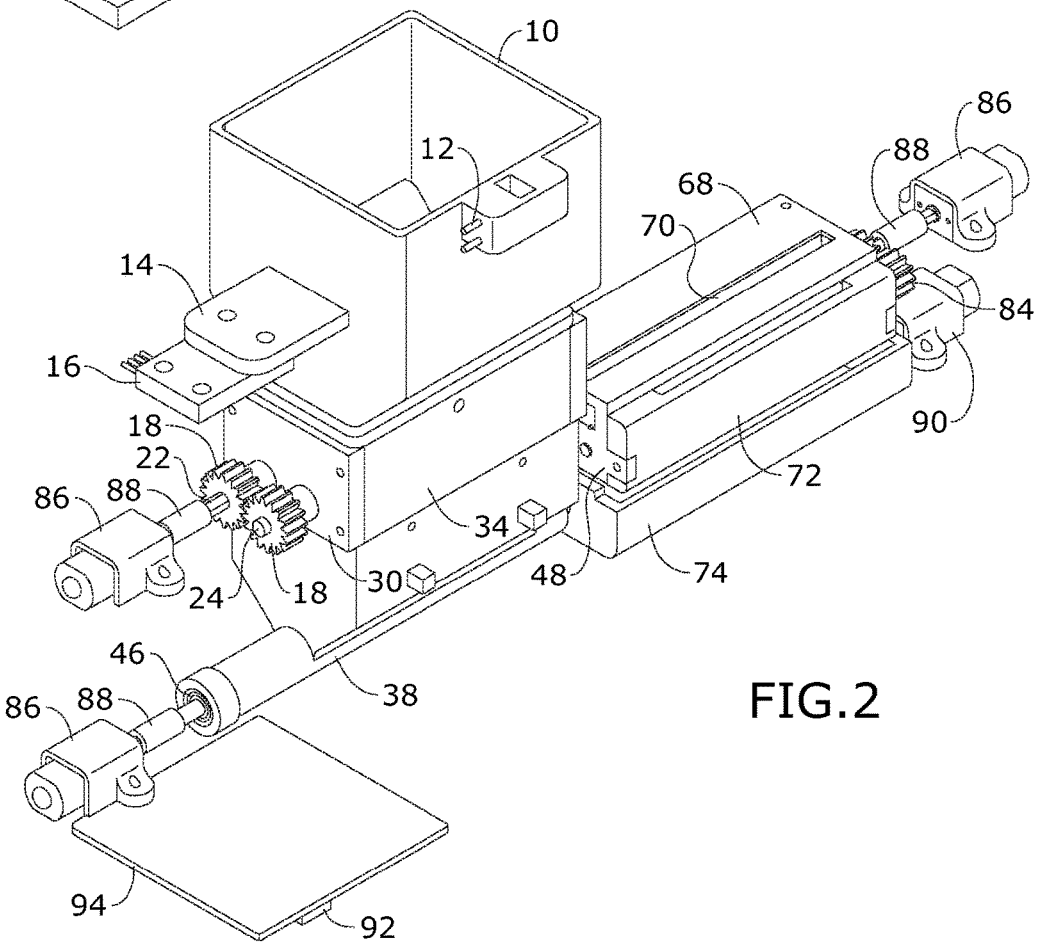
FIG. 2 is a perspective view the internals of an embodiment of the present invention.
Figure 3:
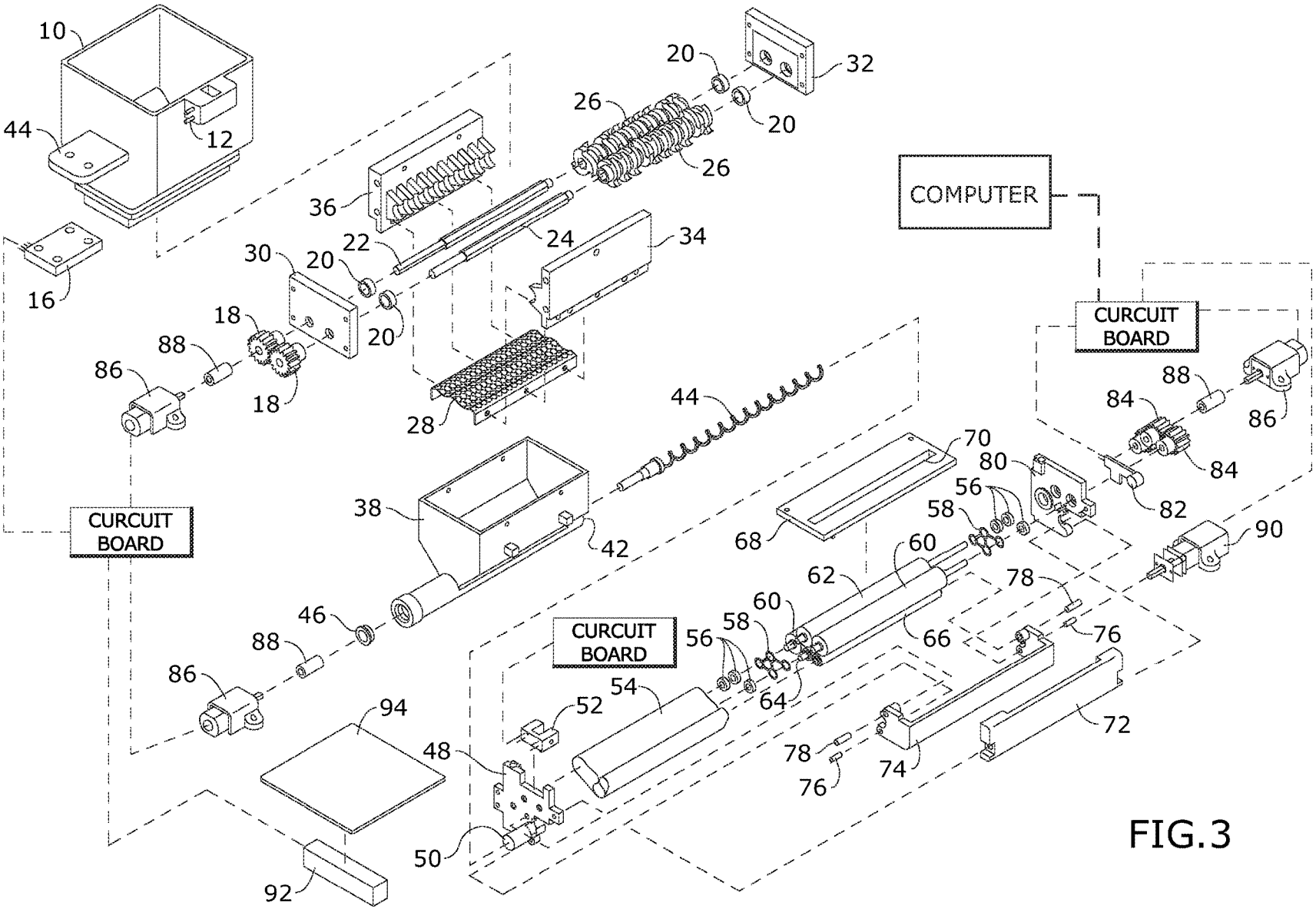
FIG. 3 is an exploded view of the internals of an embodiment of the present invention.
Figure 4:
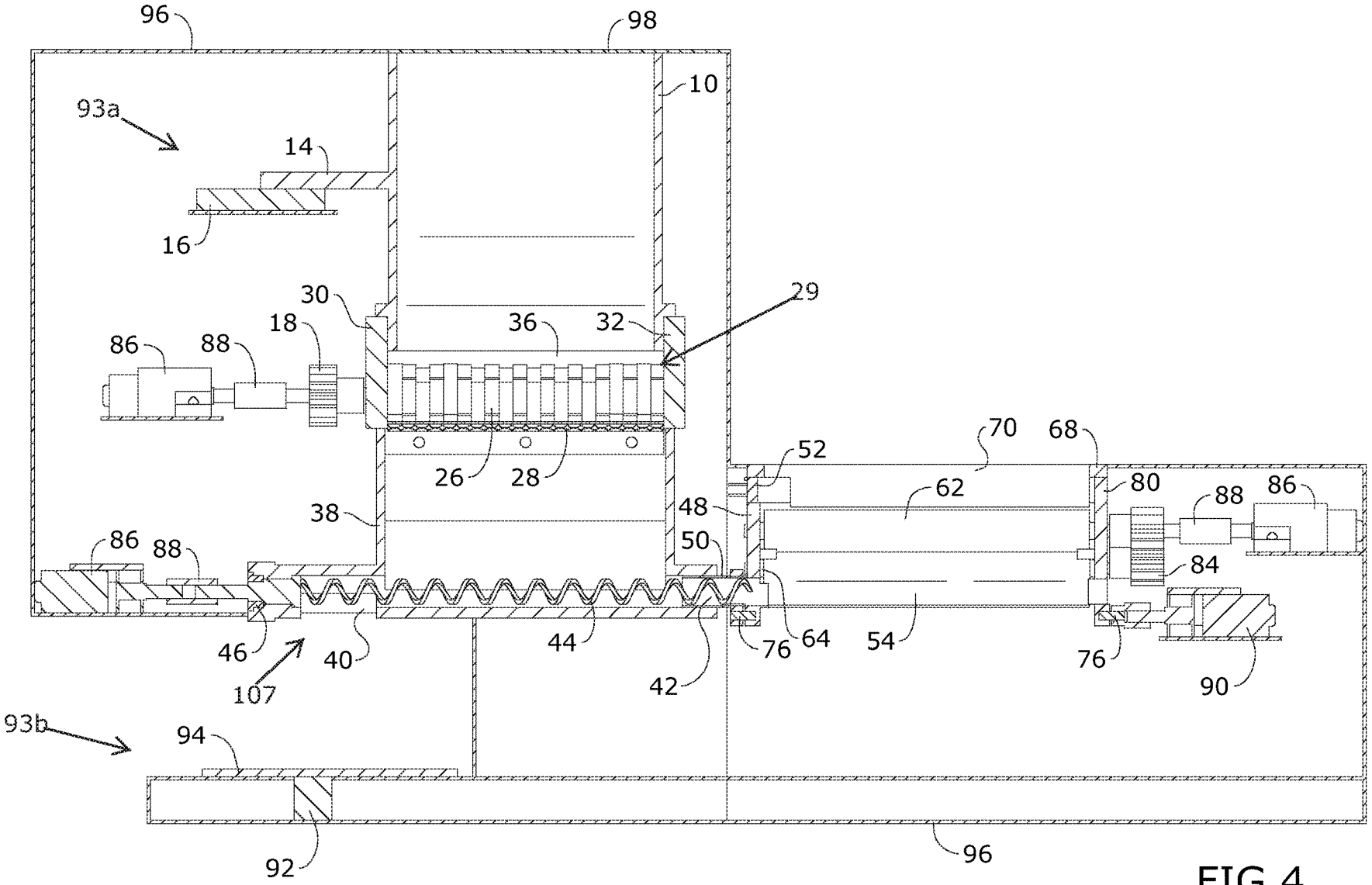
FIG. 4 is a section view of an embodiment of the present invention, taken along line 4-4 in FIG. 1.
Figure 5:
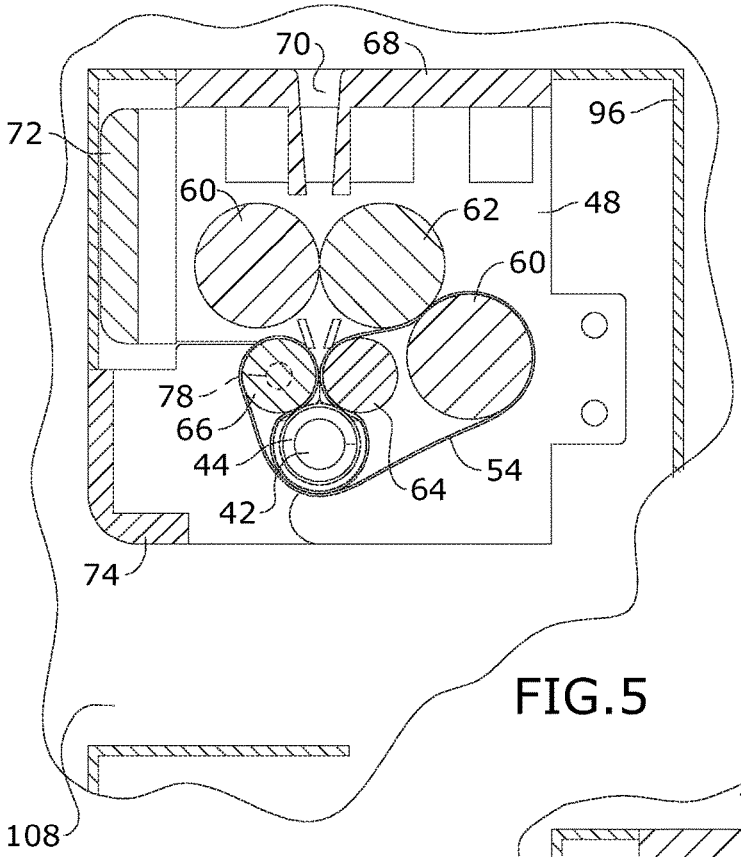
FIG. 5 is a section view of an embodiment of the present invention taken along line 5-5 in FIG. 1.
Figure 6:
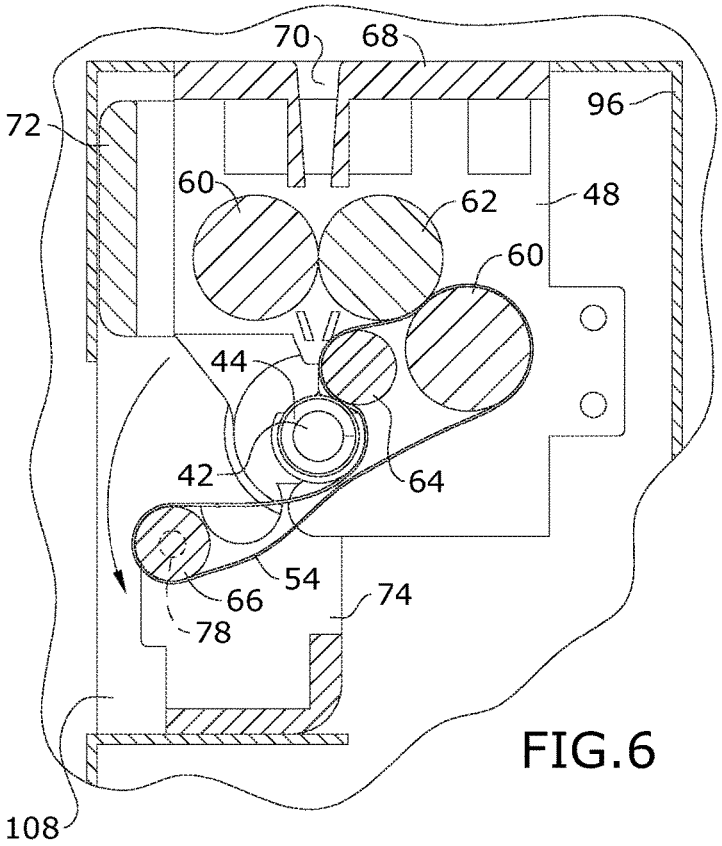
FIG. 6 is a section view of an embodiment of the present invention.
Figure 7:
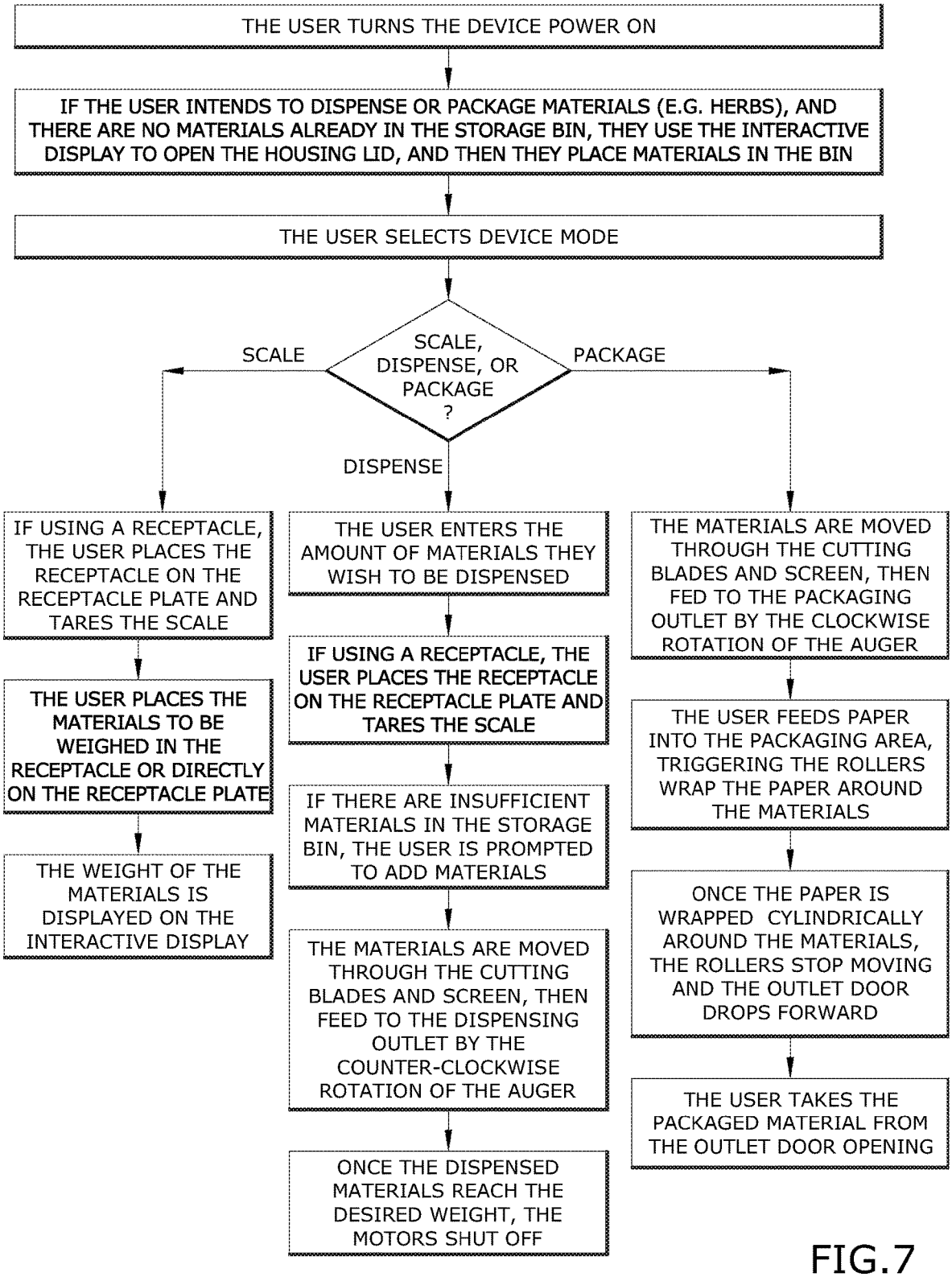
FIG. 7 is a flowchart illustrating a method of using an embodiment of the present invention.

Referring to FIGS. 1 through 7, the present invention includes an herb dispenser. The herb dispenser includes a housing 96. A receptacle 10 is secured to the housing 96 and includes an inlet and an outlet. An herb may be placed within the receptacle 10. At least one electronic scale 93*a*, 93*b* may weigh the herb. The present invention further includes a grinding mechanism 29. The grinding mechanism 29 includes a motor 86 and an herb grinder disposed within the housing 96. The grinding mechanism 29 includes an inlet and an outlet. The inlet is positioned to receive an herb from the outlet of the receptacle 10. The herb dispenser further includes an onboard computer to receive commands and automate the electronic scale 93*a*, 93*b* and the grinding mechanism 29 to dispense an amount of ground herb from the grinding mechanism outlet and through a first delivery port 107 of the housing 96.

The components of the present invention may be disposed within the housing 96. A power cord 110 may extend from the housing 96 and may be plugged into an outlet to provide power to the herb dispenser. The present invention may also be powered by batteries, such as rechargeable batteries. The receptacle 10 may be disposed within the housing 96 and a lid 98 may cover and uncover the inlet to the receptacle 10. The lid 98 may be attached to the housing by a hinge 102. A lid tab 100 may extend from the lid 98 and may be locked in a closed position by a latch 12. A first electronic scale 93*a* may weigh the amount of herb disposed within the receptacle 10. In such embodiments, a tab 14 may extend laterally from the receptacle 10. A load cell 16 may be disposed underneath the tab 14. The tab 14 may apply pressure against the load cell 16 when herb is within the receptacle 10 and the load cell 16 determines the weight of herbs within the receptacle 10. The outlet of the receptacle 10 dispenses herb into the grinding mechanism 29.

The grinding mechanism 29 may include a housing that houses the grinder having an inlet at the top to receive herb from the receptacle 10 and an outlet at the bottom to dispense ground herb. The housing may include a first side plate 30, a second side plate 32, a first front plate 34 and a second front plate 36. The herb grinder may include a first shredder shaft 22 and a second shredder shaft 24 secured to the first and second side plates 30, 32 by bearings 20. Each of the shredder shafts 24 may include shredder blades 26. A motor 86 may rotates a coupling shaft 88. The coupling shaft 88 is secured to a first gear 18 which is interlocked with a second gear 18. The first gear 18 is secured to the first shredder shaft 22 and the second gear 18 is secured to the second shredder shaft 24. Therefore, when the motor 86 is powered, the coupling shaft 88 is rotated, which in turn rotates the gears 18 and the shredder shafts 22, 24. When the shredder shafts 22, 24 are rotated, the herb within the receptacle 10 is ground. A screen 28 may be disposed below the grinder and secured to the housing outlet. Therefore, only certain sized pieces of herb may fit through the screen 28 and the housing outlet. Larger pieces are caught by the blades 26 and ground again until the pieces are small enough to pass through the screen 28.

In certain embodiments, the present invention may include a dispenser portion and a packaging mechanism. In such embodiments, the present invention includes a transport mechanism to transport the ground herb to either the dispenser portion or the packaging mechanism. The transport mechanism includes a housing 38. The housing 38 includes an inlet to receive ground herb from the outlet of the grinding mechanism 29. The housing 38 may include a trough shape leading to a shoot. The shoot includes a first outlet 40 and a second outlet 42. A bi-directional conveyor may be disposed within the shoot to deliver herb to either the first outlet 40 or the second outlet 42. For example, the conveyor may include a motor 86 that rotates a drive shaft 88. A screw auger 44, such as a shaft less screw auger, may be secured within the shoot by bearings 46. The drive shaft 88 is secured to and rotates the screw auger 44 either clockwise or counter clockwise. In certain embodiments, the first outlet 40 delivers herb to the dispenser portion and the second outlet 42 delivers herb to the packaging mechanism. The motor 86 may rotate the screw auger 44 counter clockwise to deliver the ground herb to the first outlet 40 and clockwise to deliver the ground herb to the second outlet 42.

The dispenser portion of the present invention includes the first delivery port 107. The screw auger 44 may be rotated to deliver the ground herb through the first outlet 40 and the ground herb may be dispensed out of the housing 96 through the first delivery port 107. A second electronic scale 93*b* may be disposed beneath the first delivery port 107. In such embodiments, a plate 94 may be disposed just beneath the first delivery port 107. A load cell 92 may determine a weight of the ground herb that is dispensed onto the plate 94.

As mentioned above, the present invention further includes a packaging mechanism. The packaging mechanism may package the ground herb in a rolled cigarette. The screw auger 44 may be rotated to deliver the ground herb through the second outlet 42 and into the packaging mechanism. The packaging mechanism includes a roller housing. The roller housing includes a first end plate 48, a second end plate 80, a top plate 68, a cross plate 72, and an outlet door 74 connected to the end plates 48, 80 by pivot pins 76. The top plate 68 may include an inlet slot 70 and a paper sensor 52. The first end plate 48 may include an inlet 50 to receive ground herb from the second outlet 42 and a material sensor 82 may detect that the ground herb has traveled into the packaging mechanism.

The packaging mechanism may include a plurality of rollers 60, 62, 64, 66 disposed within the housing. The plurality of rollers 60, 62, 64, 66 may include two large rollers 60, a large roller with an elongated shaft 62, a smaller roller with shafts 64 and a smaller roller with pin slots 66. Washers 58 may be secured to the ends of the rollers 60, 62, 66 and the ends of the rollers 60, 62, 66 may be secured to the end plates 48, 80 by bearings 56. As mentioned above, the outlet door 74 may be pivotally secured to the housing by pivot pins 76. The smaller roller with pin slots 66 may be secured to the outlet door by pins 78. A coupling shaft 88 connects a motor 86 to the elongated shaft of the large roller with an elongated shaft 62. The motor 86 rotates the large roller with an elongated shaft 62 which rotates interlocking gears 84, which rotates the two large rollers 60. An apron 54 surrounds rollers 60, 64, 66.

The ground herb may be delivered through the inlet 50 until the material sensor 82 is activated at which point a user may deliver a piece of paper through the inlet slot 70. A paper sensor 52 detects the paper from the inlet slot 70 and sends a signal to the onboard computer located in the housing 96. The signal triggers a sequence of events by rotating the motor 86 in a counter clockwise motion. The elongated shaft of a large roller 62 coupled to the motor 86 via coupling shaft 88 is rotated counter clockwise. The gear 84 coupled to the elongated shaft are also rotated in a counter clockwise motion which turns the interlocking gears 84 coupled to the two large rollers 60. The clockwise and counter clockwise motion of the large rollers 60, 62 pulls the paper into a small gap between the two small rollers 64, 66 below. The counterclockwise and clockwise motion of the two large rollers 60, 62 moves the apron 54 in the clockwise motion. Consequently, the clockwise motion of the apron 54 rotates the grinded herb counter clockwise in the packaging mechanism. The paper that was pulled into the gap between the two small rollers 64, 66 is sandwiched between the apron 54 and grinded herb due to the counter clockwise movement of the herb and clockwise movement of the apron 54. The cigarette is then rolled in between rollers 64, 66 and the apron 54. When the herb has been rolled within the paper to form a cigarette, the outlet door 74 may pivot open with the smaller roller with pin slots 66 and deliver the cigarette out of the second delivery port 108.

In certain embodiments, the present invention may include a touch screen 104 for a user to control the herb dispenser. The present invention may further include a speaker 106 to provide instructions. The touch screen 104 is the user interface of the computer. A user may choose from a selection including scale, dispense or package displayed on the touch screen 104. The user may be prompted to pay for the herb. IN such embodiments, the present invention may include a credit/debit card reader and a money receiving slot for the user to make payment. When the user chooses scale, a user may weigh the herb within the receptacle 96. A memory of the computer may store a predetermined code. The computer receives an entered code from the user interface, determines if the predetermined code and the entered code match, and unlocks the latch 12 if the predetermined code matches the entered code. The locking mechanism is not limited to a code and may include a biometric and RFID capabilities. The user may open the lid and place the herb within the receptacle 96. The weight of the herb within the receptacle is then displayed on the touch screen 104. The user then closes the lid 98 and the latch 12 locks the lid 98 closed. A plurality of other users may then use the user interface of the machine to dispense or roll a specified amount of herb.

If a user chooses dispense, the computer receives a command from the user interface to deliver an amount of herb, directs the motor 86 to rotate the shredder shafts 22, 24 and grind the herb, directs the motor 86 to rotate the screw auger 44 in a first direction to deliver the herb to the first outlet; and delivers the amount of the herb from the housing through the outlet of the grinding mechanism 29 and out of a first delivery port 107 of the housing. The herb may be dispensed until the load cell 92 reaches the threshold amount and the computer directs the herb dispenser to stop dispensing additional herb. If the user chooses to package the herb, the computer receives a command from the user interface to roll or package the herb, directs the motor 86 to rotate the shredder shafts 22, 24 and grind the herb, directs the motor 86 to rotate the screw auger 44 in a second direction opposite the first direction to deliver the herb to the second outlet, and into the rolling mechanism. The user then applies moisture to the gum in sheet of rolling paper and places the sheet of rolling paper through the inlet slot 70. The sensors 52, 82 send a signal to the computer that the herb and the paper have been received. The motor 86 is then activated to rotate the rollers 60, 62 and roll the herb within the paper. The outlet door 74 is pivoted open by a motor 90 and the rolled cigarette is delivered through the second delivery port 108.

It should be understood, of course, that the foregoing relates to exemplary embodiments of the invention and that modifications may be made without departing from the spirit and scope of the invention as set forth in the following claims.

What is claimed is:

1. An herb dispenser comprising:

a housing;

a receptacle secured to the housing and comprising an inlet and an outlet;

at least one electronic scale;

a grinding mechanism comprising a motor and an herb grinder disposed within the housing, wherein the grinding mechanism comprises an inlet and an outlet, wherein the inlet is positioned to receive an herb from the outlet of the receptacle;

a transport mechanism comprising an inlet positioned to receive the herb from the outlet of the grinding mechanism, a first outlet and a second outlet, and a conveyor operable to convey herb in a first direction to the first outlet and a second direction to the second outlet;

a first delivery port leading to an outside of the housing and positioned to receive herb from the first outlet;

a packaging mechanism positioned to receive the herb from the second outlet and configured to roll the herb within a piece of paper to form a cigarette;

a second delivery port leading to the outside of the housing and positioned to receive the cigarette from the packaging mechanism; and a computer comprising a processor, a memory and a user interface, wherein the processor:

receives a command from the user interface to deliver an amount of an herb;

prompts a user to select one of a dispensing command and a rolling command on the user interface;

measures the amount of the herb using the electronic scale;

directs the herb grinder to grind the herb;

directs the conveyor to convey the herb to the second outlet and into the packaging mechanism if the rolling command is selected; and directs the conveyor to convey the herb to the first outlet and out of the first delivery port if the dispensing command is selected.

2. The herb dispenser of claim 1, further comprising a lid secured to the housing and covering an opening of the housing leading into the receptacle, wherein the housing comprises a latch operable to lock the lid in a closed position.

3. The herb dispenser of claim 2, wherein the memory comprises a predetermined code to unlock the latch, wherein the processor:

receives an entered code from the user interface;

determines if the predetermined code and the entered code match; and unlocks the latch if the predetermined code matches the entered code.

4. The herb dispenser of claim 1, wherein the herb grinder comprises a pair of elongated shafts each comprising shredder blades, wherein the motor rotates each of the pair of elongated shafts.

5. The herb dispenser of claim 1, further comprising a screen disposed below the grinder and above the outlet of the grinding mechanism.

6. The herb dispenser of claim 1, wherein the packaging mechanism comprises:

a roller housing comprising a paper inlet, an herb inlet, and the second delivery port wherein the herb inlet is positioned to receive herb from the second outlet;

a plurality of rollers;

a motor operatively connected to the plurality of rollers; and a cape surrounding at least two of the plurality of rollers, wherein the rollers and the cape are operable to receive the herb and a piece of paper and roll the herb within the piece of paper to form a cigarette, and the cigarette is dispensed from the second delivery port.

7. The herb dispenser of claim 6, further comprising a sensor operable to sense when the piece of paper enters the paper inlet, wherein the processor receives a signal from the sensor that the piece of paper has entered the paper inlet; and directs the packaging mechanism to roll the herb within the piece of paper to form the cigarette once the signal is received.

8. The herb dispenser of claim 1, wherein the at least one electronic scale is positioned to receive the herb from the first delivery port, wherein the processor directs the conveyor to deliver the ground herb to the at least one electronic scale until the at least one electronic scale measures the amount.

9. The herb dispenser of claim 1, wherein the conveyor is a screw auger, wherein the processor:

directs the motor to rotate the screw auger in a first direction of rotation to deliver the herb to the first outlet; and directs the motor to rotate the screw auger opposite the first direction of rotation to deliver the herb to the second outlet.

10. The herb dispenser of claim 1, wherein the user interface is a touch screen.

11. The herb dispenser of claim 1, wherein the at least one electronic scale comprises a first load cell operable to measure a weight of the herb within the receptacle and a second load cell operable to measure the weight of the herb delivered from of the first delivery port.

12. The herb dispenser of claim 1, wherein the first direction is different than the second direction.

* * * * *